US010193215B2

(12) United States Patent
Mai

(10) Patent No.: US 10,193,215 B2
(45) Date of Patent: Jan. 29, 2019

(54) ANTENNA DEVICE AND MOBILE TERMINAL

(71) Applicant: Jianchun Mai, Shenzhen (CN)

(72) Inventor: Jianchun Mai, Shenzhen (CN)

(73) Assignee: AAC TECHNOLOGIES PTE. LTD., Singapore (SG)

( * ) Notice: Subject to any disclaimer, the term of this patent is extended or adjusted under 35 U.S.C. 154(b) by 123 days.

(21) Appl. No.: 15/417,195

(22) Filed: Jan. 26, 2017

(65) Prior Publication Data

US 2018/0115052 A1 Apr. 26, 2018

(30) Foreign Application Priority Data

Oct. 25, 2016 (CN) ..... 2016 1 0940525

(51) Int. Cl.
*H01Q 1/24* (2006.01)
*H01Q 21/28* (2006.01)
*H01Q 9/06* (2006.01)

(52) U.S. Cl.
CPC ..... *H01Q 1/243* (2013.01); *H01Q 1/24* (2013.01); *H01Q 9/06* (2013.01); *H01Q 21/28* (2013.01)

(58) Field of Classification Search
CPC ..... H01Q 1/243; H01Q 1/48; H01Q 1/24; H01Q 21/28; H01Q 9/06
USPC ..... 343/702, 729
See application file for complete search history.

(56) References Cited

U.S. PATENT DOCUMENTS

2014/0266922 A1* 9/2014 Jin ..... H01Q 21/28 343/702
2016/0056527 A1* 2/2016 Pascolini ..... G06K 9/00006 343/702
2016/0351991 A1* 12/2016 Chen ..... H04B 5/0081

* cited by examiner

*Primary Examiner* — Hai V Tran
(74) *Attorney, Agent, or Firm* — Na Xu; IPro, PLLC

(57) ABSTRACT

The present disclosure provides an antenna device. The antenna device includes a metal back plate, a metal frame surrounding a periphery of the metal back plate and is connected with the metal back plate, and a radiator configured to receive and radiate electromagnetic waves, the metal back plate and the radiator are spaced so as to from a gap, the gap includes a first gap provided along a short axis direction of the metal back plate and a second gap and a third gap which are bended and extend from two ends of the first gap, respectively, a length of the first gap is smaller than a width of the metal back plate along its short axis. The antenna device of the present disclosure has less influence to antenna performance when being hand-held, and the antenna radiating performance is good.

9 Claims, 4 Drawing Sheets

ANTENNA DEVICE AND MOBILE TERMINAL

TECHNICAL FIELD

The present disclosure relates to the field of mobile communication technologies and, in particular, to an antenna device and a mobile terminal.

BACKGROUND

With the continuous development of mobile terminal devices such as cellphone, tablet PC etc, people have much higher requirements on appearance and performance of the mobile terminal devices. Mobile terminal with metal housing become more and more popular to the consumers due to its texture and abrasion resistance property.

Mobile terminals in the related art generally include two parallelly provided gaps on the metal back cover as the antenna radiator, and ends of the horizontal gaps are located at two sides of the cellphone. The above design, in an aspect, leads to a relative large size of the antenna radiator, which occupies the placing position of adjacent components; in another aspect, since the ends of the gaps are located at two sides of the cellphone, when the user is holding the cellphone, the antenna performance is poor.

Therefore, there is a necessity to provide a new antenna device so as to solve the above problem.

BRIEF DESCRIPTION OF DRAWINGS

Many aspects of the exemplary embodiments can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DESCRIPTION OF EMBODIMENTS

The present invention will be further illustrated with reference to the accompanying drawings and the embodiments.

Figure 1:
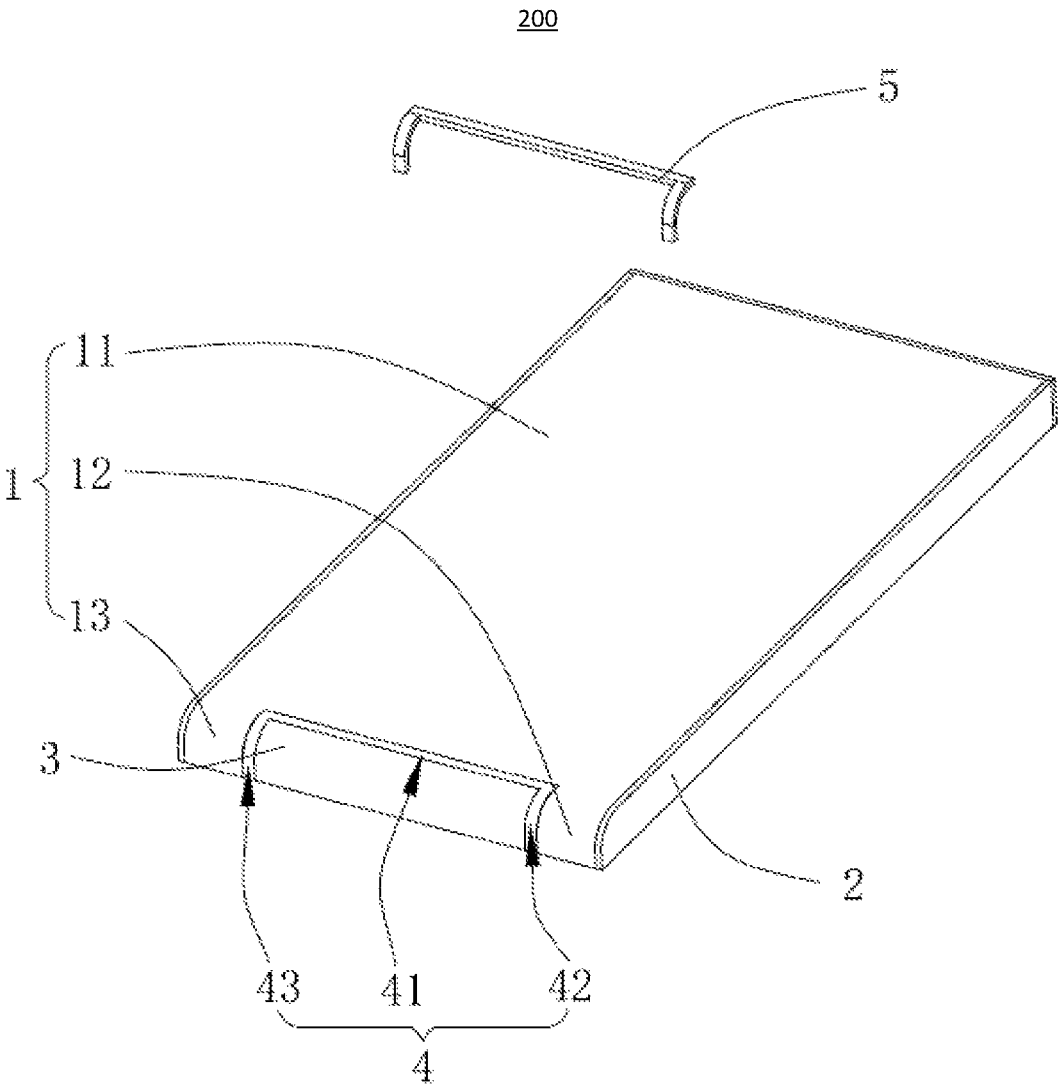
FIG. 1 is a perspective structural view of an antenna device in accordance with the present disclosure.

Please refer to FIG. 1, which is a perspective structural view of an antenna device in accordance with the present disclosure. The antenna device 200 includes a metal back plate 1 and a metal frame 2 surrounding the periphery of the metal back plate 1 and is connected with the metal back plate 1, and a radiator 3 configured to receive and radiate electromagnetic waves, a gap 4 is formed between the metal back plate 1 and the radiator 3 so as to space the metal back plate 1 with the radiator 3, and an isolating connecting piece 5 is provided to connect the metal back plate 1 with the radiator 3.

The metal back plate 1 includes a back plate body 11 and a first extending portion 12 and a second extending portion 13 which are provided at two sides of the radiator 3 and respectively extend from the back plate body 11, the first extending portion 12 and the second extending portion 13 are respectively connected with the metal frame 2, the back plate body 11, the first extending portion 12 and the second extending portion 13 form an "H" shape.

The gap 4 includes a first gap 41 provided along a short axis direction of the metal back plate 1 and a second gap 42 and a third gap 43 bended and extended from two ends of the first gap 41, respectively. The length of the first gap 41 is smaller than the width of the metal back plate 1 along its short axis. Through arranging the length of the first gap 41 to be smaller than the width of the metal back plate 1 along its short axis, a mobile terminal adopting the antenna device 200 can shorten the transverse size of the radiator 3 which serves as the antenna sheet, thereby the internal components in the mobile terminal will be more compact.

The first gap 41 is formed between the back plate body 11 and the radiator 3, the radiator 3 forms the second gap 42 and the third gap 43 respectively with the first extending portion 12 and the second extending portion 13. The gap 4 is of a "U" shape. Specifically, the first gap 41 is provided along a direction perpendicular to the metal frame 2, the first gap 41 is perpendicular to the second gap 42 and the third gap 43 at the same time, and the second gap 42 and the third gap 43 forms an arc shape. Through bending the gap 4 to be a U shape, the mobile terminal adopting the antenna device 200 reduces the size of the radiator 3 which serves as the antenna sheet, non-antenna regions at two sides thereof can be provided with other components; moreover, the positions of the ends of the antenna radiator are placed at the bottom of the cellphone, the two ends of the gap 4 are not arranged at two sides of the cellphone, so that the radiating ends are far away from the hand-hold position, thereby bringing less influence to the antenna performance when being hand-held.

In the present embodiment, the length of the radiator 3 is 46 mm, the width thereof is 5 mm. The width of the gap 4 is 2 mm, and the widths of the first gap 41, the second gap 42 and the third gap 43 are the same, the width is the distance between the metal back plate 1 and the radiator 3.

Figure 2:
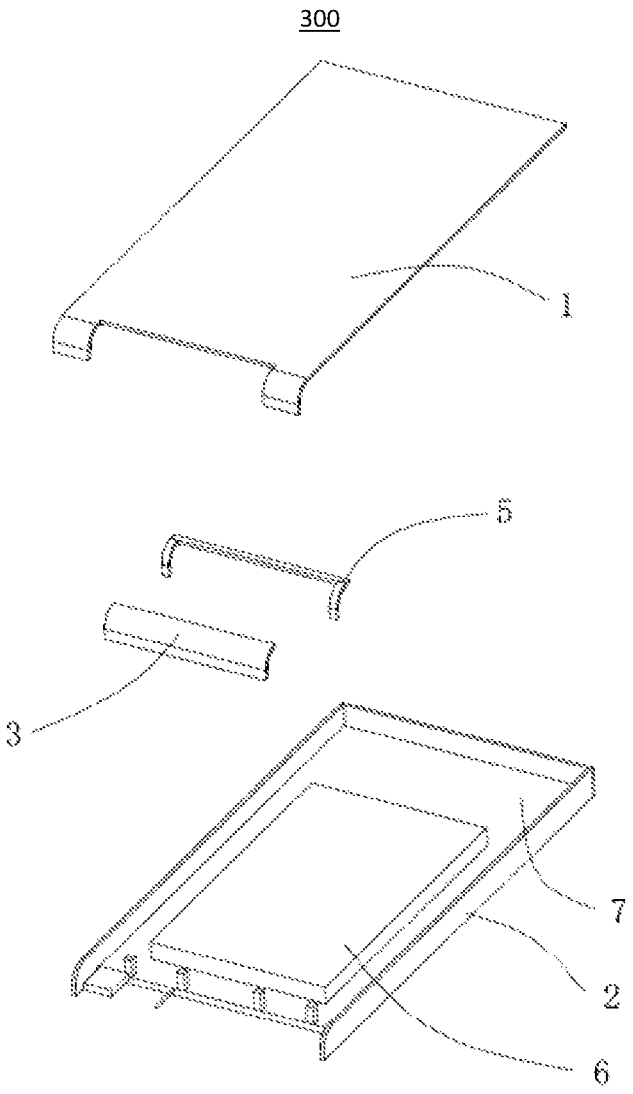
FIG. 2 is a perspective structural exploded view of a mobile terminal adopting the antenna device in accordance with the present disclosure.

Please refer to FIG. 2, which is a perspective structural exploded view of a mobile terminal adopting the antenna device in accordance with the present disclosure. The mobile terminal 300 includes the antenna device 200, the mobile terminal 300 further includes a battery 6 and a display plate 7 accommodated in the metal back plate 1 and the metal frame 2. In the mobile terminal 300, the gap 4 of the metal back plate 1 and the radiator 3 is bended, so that the size of the radiator 3 which serves as the antenna radiating sheet can be reduced and the two ends of the gap 4 are not located at two sides of the mobile terminal, but at the bottom of the mobile terminal 200, so that the radiating ends are far away from the hand-hold position, thereby bringing less influence to the antenna performance when being hand-held, and thus improving the radiating performance.

Figure 3:
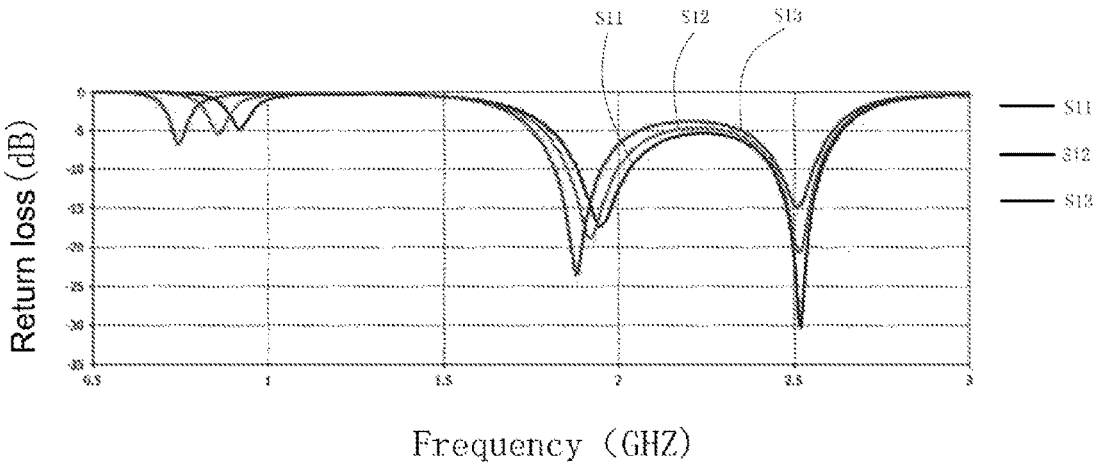
FIG. 3 is a view showing return loss of an antenna device in accordance with the present disclosure.
Figure 4:
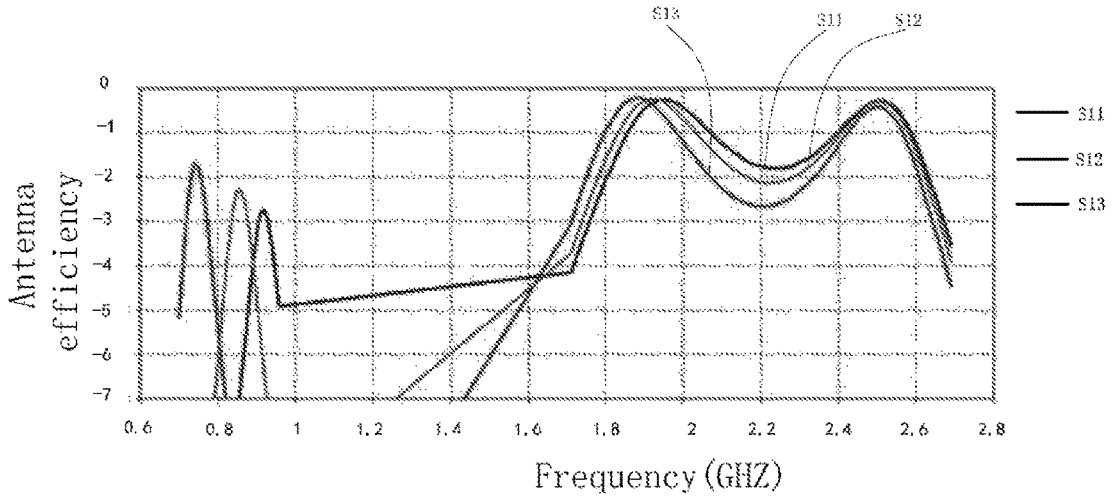
FIG. 4 is a view showing antenna efficiency of an antenna device in accordance with the present disclosure.

Please refer to FIG. 3 and FIG. 4, FIG. 3 is a view showing return loss of an antenna device in accordance with the present disclosure; FIG. 4 is a view showing antenna efficiency of an antenna device in accordance with the present disclosure. From the figures, it can be seen that the return loss is relative large when the antenna device 200 is in a middle-high frequency, and the antenna efficiency is relative large. When there is a need to transmit low frequency signal, the right end of the radiator 3 is used for radiation; when transmitting middle frequency signal, the right end of the radiator 3 is used for ultra-harmonics radiation; when transmitting high frequency signal, the left end of the radiator 3 is used for radiation.

Comparing with the related art, in the antenna device of the present disclosure, the gap between the metal back plate and the radiator is bended, the length of the gap is smaller than the width of the metal back plate along its short axis, so that the size of the radiator which serves as the antenna radiating sheet is reduced and the two ends of the gap are not located at two sides of the mobile terminal, but at the bottom of the mobile terminal, so that the radiating ends are far away from the hand-hold position, thereby bringing less influence to the antenna performance when being hand-held, and thus improving the radiating performance.

It should be noted that, the above are merely embodiments of the present invention, those skilled in the art can make improvements without departing from the inventive concept of the present invention, however, these improvements shall belong to the protection scope of the present invention.

What is claimed is:

1. An antenna device, comprising:

a metal back plate;

a metal frame surrounding a periphery of the metal back plate and is connected with the metal back plate; and a radiator configured to receive and radiate electromagnetic waves;

wherein the metal back plate and the radiator are spaced so as to from a gap, the gap comprises a first gap provided along a short axis direction of the metal back plate and a second gap and a third gap which are bended and extend from two ends of the first gap, respectively, a length of the first gap is smaller than a width of the metal back plate along its short axis;

wherein an extending direction of the second gap is same to that of the third gap and at least a part of the radiator is surrounded by the metal back plate.

2. The antenna device as described in claim 1, wherein the metal back plate comprises a back plate body and a first extending portion and a second extending portion which are provided at two sides of the radiator and respectively extend from the back plate body, the first extending portion and the second extending portion are respectively connected with the metal frame.

3. The antenna device as described in claim 2, wherein the first gap is provided between the back plate body and the radiator, the second gap is provided between the radiator and the first extending portion, the third gap is provided between the radiator and the second extending portion.

4. The antenna device as described in claim 1, wherein the first gap is perpendicular to the second gap and the third gap, respectively, and the second gap and the third gap are of an arc shape.

5. The antenna device as described in claim 1, wherein the gap is distributed to be a U shape.

6. The antenna device as described in claim 1, wherein a length of the radiator is 46 mm, a width thereof is 5 mm.

7. The antenna device as described in claim 1, wherein a width of the gap is 2 mm.

8. The antenna device as described in claim 1, further comprising an isolating connecting piece which fits with a shape of the gap, the isolating connecting piece is embedded into the gap, configured to connect the metal back plate with the radiator.

9. A mobile terminal device, wherein the mobile terminal device adopts the antenna device as described in claim 1.

* * * * *